US010322311B2

(12) United States Patent
Naomi

(10) Patent No.: US 10,322,311 B2
(45) Date of Patent: Jun. 18, 2019

(54) PORTABLE WORKOUT POUCH FOR MEDICINE BALL

(71) Applicant: WePo Fitness Inc., Arlington Heights, IL (US)

(72) Inventor: Hesbon Mwangi Naomi, Arlington Heights, IL (US)

(73) Assignee: WePo Fitness Inc., Arlington Heights, IL (US)

( * ) Notice: Subject to any disclaimer, the term of this patent is extended or adjusted under 35 U.S.C. 154(b) by 0 days.

(21) Appl. No.: 16/179,912

(22) Filed: Nov. 3, 2018

(65) Prior Publication Data

US 2019/0111308 A1 Apr. 18, 2019

Related U.S. Application Data

(63) Continuation of application No. PCT/US2018/018455, filed on Feb. 15, 2018.
(Continued)

(51) Int. Cl.
*A63B 21/00* (2006.01)
*A63B 21/06* (2006.01)
(Continued)

(52) U.S. Cl.
CPC ..... *A63B 21/4035* (2015.10); *A63B 21/0601* (2013.01); *A63B 21/4011* (2015.10);
(Continued)

(58) Field of Classification Search
CPC ..... A63B 21/0601; A63B 21/4011; A63B 21/4035; A63B 23/0355; A63B 47/00;
(Continued)

(56) References Cited

U.S. PATENT DOCUMENTS 5,238,162 A 8/1993 LaCivita
5,401,034 A 3/1995 Mallinger
(Continued)

FOREIGN PATENT DOCUMENTS

WO 2007016727 A1 2/2007

OTHER PUBLICATIONS

Renouf Fitness, Medicine Ball Harness MBM [retrieved on Nov. 18, 2018]. Retrieved from the Internet: <URL: http://www.renouffitnessequipment.com.au/equipment/crossfit-equipment/medicine-ball-harness-mbm/>.
(Continued)

*Primary Examiner* — Joshua Lee
(74) *Attorney, Agent, or Firm* — Hojka Qadeer, LLC; Umair A. Qadeer

(57) ABSTRACT

A workout pouch comprising multiple pieces of fabric fastened together to form a spherical receptacle to securely contain a medicine ball is disclosed herein. The spherical receptacle facilitates working out using the medicine ball. The workout pouch conforms to the size and shape of the medicine ball. The pouch secures the medicine ball so as to prevent the medicine ball from shifting within the pouch during exercise. The pouch may also include one or more support patches to enhance its structural integrity and resistance to wear-and-tear damage. The workout pouch may include straps and strap fasteners to allow a user to fasten the straps to the user's body. The pouch may also include a ball fastener to properly secure a medicine ball within the body of the pouch and a ball fastener protector that prevents the ball fastener from being exposed while the pouch is in use.

11 Claims, 7 Drawing Sheets

Related U.S. Application Data

(60) Provisional application No. 62/459,101, filed on Feb. 15, 2017.

(51) Int. Cl.
*A63B 47/00* (2006.01)
*A63B 71/00* (2006.01)
*A63B 23/035* (2006.01)

(52) U.S. Cl.
CPC ..... *A63B 23/0355* (2013.01); *A63B 47/00* (2013.01); *A63B 71/0036* (2013.01); *A63B 71/0054* (2013.01); *A63B 2209/10* (2013.01)

(58) Field of Classification Search
CPC ..... A63B 71/0036; A63B 71/0054; A63B 2209/10
See application file for complete search history.

(56) References Cited

U.S. PATENT DOCUMENTS 6,475,125 B1 11/2002 Roberts
6,547,703 B1 4/2003 Swezey et al.
7,794,336 B2 9/2010 Wu et al.
7,901,339 B2 * 3/2011 Schechter ..... A63B 21/00047 482/142
D683,800 S * 6/2013 Ebio ..... D21/662
8,882,642 B2 * 11/2014 Chavez ..... A63B 21/0442 482/121
D718,825 S * 12/2014 Ross ..... D21/662
9,248,348 B2 * 2/2016 Newman ..... A63B 37/12
9,616,272 B1 * 4/2017 Bennett ..... A63B 21/075
2008/0178978 A1 7/2008 Power
2010/0326854 A1 12/2010 Ting
2011/0201458 A1 8/2011 Elder
2012/0149536 A1 6/2012 Trimble et al.
2012/0184418 A1 7/2012 Wilson
2012/0289382 A1 11/2012 Haddad et al.
2013/0085045 A1 4/2013 Chavez et al.
2014/0342859 A1 11/2014 Newman
2015/0045191 A1 * 2/2015 Carter ..... A63B 65/06 482/93
2015/0314156 A1 * 11/2015 Crandall ..... A63B 23/03558 482/93

OTHER PUBLICATIONS

Title Boxing Gear, Title Medicine Ball Sling Bag [retrieved on Nov. 18, 2018]. Retrieved from the Internet: <URL: https://www.titleboxing.com/title-medicine-ball-sling-bag>.
Jump USA, Speed Swing Medicine Ball Sling [retrieved on Nov. 18, 2018]. Retrieved from the Internet: <URL: http://www.jumpusa.com/pc/SPEDSWNG/MEDBALLACC/Speed+Swing+Medicine+Ball+Sling.html>.
Lacertosus, Medicine Ball Harness [retrieved on Nov. 18, 2018]. Retrieved from the Internet: <URL: https://www.lacertosus.com/en/42-medicine-ball-harness.html>.
Live Well Sports, FitBall MedBalls with Straps Red 6 lbs 9 [retrieved on Nov. 18, 2018]. Retrieved from the Internet: <URL: https://livewellsports.com/fitball-medballs-with-straps-red-6-lbs-9>.
Track & Field, Kytec Medicine Ball Sling [retrieved on Nov. 18, 2018]. Retrieved from the Internet: <URL: https://www.trackandfieldsports.com/kytec-medicine-ball-sling-389-p.asp>.

* cited by examiner

PORTABLE WORKOUT POUCH FOR MEDICINE BALL

CROSS-REFERENCE TO RELATED APPLICATIONS

This application is a continuation-in-part of PCT Patent Application No. PCT/US2018/018455, filed on Feb. 15, 2018, which claims priority to U.S. Provisional Patent Application Ser. No. 62/459,101, filed on Feb. 15, 2017, the disclosures of which are incorporated herein in their entireties by reference.

BACKGROUND

Field of the Invention

The present disclosure relates to a workout pouch for use with a medicine ball.

Description of the Related Art

Physicians, public health agencies, and others frequently promote physical activity and aerobic exercise to enhance cardiac and respiratory fitness. An exercise where a person moves his or her body against resistance is a resistance training exercise. Resistance training is also known as strength training or, if weighted objects are used in the exercise, weight training.

Weighted objects used in resistance training include dumbbells, barbells, weighted vests, weight plates, kettlebells, medicine balls, and cable pulley machines. There are numerous benefits of resistance training, including improving muscular strength and endurance, preventing chronic diseases such as osteoporosis and lower-back pain, reducing the risk of cardiovascular disease and certain types of cancer, increasing energy level, improving mood and sleep, and numerous other benefits.

Proper resistance training involves precise, controlled movements during exercise. Using a weighted object of the proper weight and shape for a given exercise is important for properly controlling movements. In addition, accessories that assist in gripping and securing weighted objects used in resistance training enable further control of movement.

Various accessories to secure weighted objects for use in resistance training have been disclosed. U.S. Patent Application Publication No. 2015/0314156 discloses an adjustable sling for holding various sized medicine balls. U.S. Pat. No. 6,547,703 discloses an isometric exercise ball with handles. U.S. Pat. No. 8,882,642 discloses a medicine ball capable of having accessories attached thereto. U.S. Pat. No. 7,794,336 discloses a net for enclosing a medicine ball connected to a tether. U.S. Pat. No. 6,475,125 discloses a harness to assist with performing aerobic exercises on a therapeutic ball. U.S. Patent Application Publication No. 2012/0289382 discloses an exercise device to support weight from hand grips using straps. U.S. Patent Application Publication No. 2011/0201458 discloses a harness and tether for use when performing upper body exercises. The X-Bag (www.iflextrain.com/x-bag.html) is an adjustable multipurpose bag for use as a kettlebell, medicine ball, or dumbbell.

However, there remains a significant need for a durable, portable workout pouch for use with a medicine ball that conforms to the size and shape of a medicine ball without excess material that may interfere with a given exercise and that secures the medicine ball in a way that prevents the medicine ball from shifting within the pouch during exercise.

SUMMARY

A workout pouch comprising multiple pieces of fabric fastened together, wherein the multiple pieces of fabric may be configured to form a spherical receptacle to securely contain a medicine ball, is disclosed herein. The multiple pieces of fabric may be fastened together by sewing to comprise the body of the workout pouch. The fabric may preferably comprise leather, nylon, or another strong and durable fabric material. The workout pouch may preferably further comprise one or more support patches, more preferably at least two support patches, and even more preferably two support patches on opposite sides of the body of the workout pouch to increase the strength and firmness of the workout pouch. The workout pouch may be folded when not in use and may be expanded to form a spherical receptacle to securely contain a medicine ball, wherein the spherical receptacle facilitates working out using the medicine ball. The workout pouch may further comprise one or more straps, wherein the straps may be permanently affixed to the body of the workout pouch or wherein the straps may be removable. The straps may also preferably be padded. In some embodiments, the straps may further comprise one or more strap fasteners to allow a user to fasten the straps to the user's body. The workout pouch may preferably comprise two straps. The strap fasteners may comprise one or more of Velcro, fastening clips, buttons, or other fasteners. In some embodiments, the pouch may further comprise a ball fastener to properly secure a medicine ball within the body of the pouch. In some embodiments, the ball fastener may comprise a zipper attached to the body of the pouch.

The disclosed workout pouch is designed to enclose a medicine ball of a particular size. By varying the composition of the medicine ball, a variety of weights may be available for a medicine ball of a given size. The workout pouch conforms to the size and shape of the medicine ball and does not include excess material that may interfere with a given exercise when using the pouch. The pouch secures the medicine ball in a way that prevents the medicine ball from shifting within the pouch during exercise.

DETAILED DESCRIPTION OF THE ILLUSTRATED EMBODIMENTS

Figure 1:
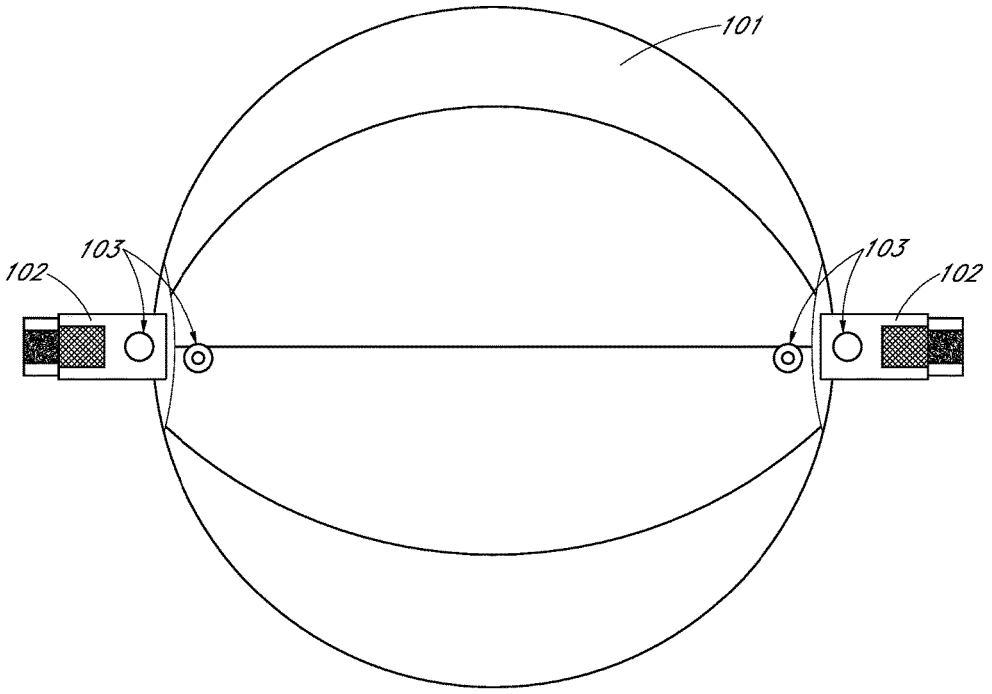
FIG. 1 shows a top view of an embodiment of the workout pouch with a medicine ball contained therein.

A workout pouch comprising multiple pieces of fabric fastened together, wherein the multiple pieces of fabric may be configured to form a spherical receptacle to securely contain a medicine ball, is disclosed herein. The multiple pieces of fabric may be fastened together by sewing to comprise the body of the workout pouch. The fabric may preferably comprise leather, nylon, or another strong and durable fabric material. The workout pouch may preferably further comprise one or more support patches, more preferably at least two support patches, and even more preferably at least two support patches on opposite sides of the body of the workout pouch to increase the strength and firmness of the workout pouch. The workout pouch may be folded when not in use and may be expanded to form a spherical receptacle to securely contain a medicine ball, wherein the spherical receptacle facilitates working out using the medicine ball. The workout pouch may further comprise one or more straps, wherein the straps may be permanently affixed to the body of the workout pouch or wherein the straps may be removable. The straps may also preferably be padded. In some embodiments, the straps may further comprise one or more strap fasteners to allow a user to fasten the straps to the user's body. The workout pouch may preferably comprise two straps. The strap fasteners may comprise one or more of Velcro, fastening clips, buttons, or other fasteners. In some embodiments, the pouch may further comprise a ball fastener to properly secure a medicine ball within the body of the pouch. In some embodiments, the ball fastener may comprise a zipper attached to the body of the pouch.

The disclosed workout pouch is designed to enclose a medicine ball of a particular size. By varying the composition of the medicine ball, a variety of weights may be available for a medicine ball of a given size. The workout pouch conforms to the size and shape of the medicine ball and does not include substantial excess material that may interfere with a given exercise when using the pouch. The pouch secures the medicine ball in a way that prevents the medicine ball from shifting within the pouch during exercise.

In some embodiments, the workout pouch may be foldable. The body of the pouch may preferably comprise a strong and durable fabric, such as nylon or leather, that is also sufficiently flexible to allow folding of the pouch. The foldability of the pouch may enhance portability and increase ease of storage. In some embodiments, the maximum dimension of the pouch when folded may be approximately 3-4 inches.

In some embodiments, the number of pieces of fabric that are fastened together to form the body of the workout pouch may preferably be eight.

In some embodiments, the workout pouch may further comprise one or more straps, wherein the straps may preferably be padded. The number of straps may preferably be two, wherein the two straps are situated on opposite sides of the body of the pouch. The padding may comprise wool, fleece, synthetic foam, or another material suitable for use as padding. The padding may prevent irritation or scratching of a user while the workout pouch is in use by the user, and may also absorb the user's sweat when the user exercises using the pouch.

In some embodiments, the straps may further comprise one or more strap fasteners to allow a user to fasten the straps to the user's body. The workout pouch may preferably comprise two straps. The strap fasteners may comprise one or more of Velcro, fastening clips, buttons, or other fasteners.

In some embodiments, the workout pouch may comprise one or more support patches. The pouch may preferably comprise two or more support patches. More preferably, the workout pouch may comprise at least two support patches on opposite sides of the body of the pouch, and even more preferably the workout pouch may comprise two exterior support patches on opposite sides of the exterior of the body of the pouch and two additional interior support patches on opposite sides of the interior of the body of the pouch, where each exterior support patch is situated on the same part of the body of the pouch as one interior support patch. Most preferably, each exterior support patch is permanently affixed to each corresponding interior support patch on the same side. The support patches may increase the strength and firmness of the pouch when in use with a medicine ball contained therein and may also secure the straps to the body of the pouch. The support patches may be configured to allow the ball fastener to be secured thereto without interfering with the interface between the support patches and the straps.

In some embodiments, the straps may be removable. The straps may be removably secured to the body of the workout pouch or to the support patches using one or more buttons or other fasteners. In other embodiments, the straps may be permanently affixed to the pouch. In such embodiments, the straps may preferably be sewn onto the support patches or directly onto the body of the pouch, or may otherwise be securely affixed to the support patches or directly to the body of the pouch. Most preferably, the straps may be permanently affixed to the support patches. When a user fastens the straps to the user's body to use the workout pouch during exercise and applies tension to the straps during use, the most significant stresses will be imparted to the workout pouch via the straps. Thus, without straps affixed to support patches to provide additional strength, the workout pouch may be subjected to stresses that exceed its structural integrity, thereby resulting in tearing or other damage to the pouch.

In some preferred embodiments, the workout pouch comprises two support patches on opposite sides of the exterior of the body of the pouch and two additional support patches on opposite sides of the interior of the body of the pouch, where each exterior support patch is situated on the same part of the body of the pouch as one interior support patch, and where each exterior support patch is permanently affixed to its corresponding interior support patch. In some highly preferred embodiments, the workout pouch comprises two exterior support patches on opposite sides of the exterior of the body of the pouch, two interior support patches on opposite sides of the interior of the body of the pouch, and two straps situated on opposite sides of the body of the pouch, where each exterior support patch is situated on the same part of the body of the pouch as one interior support patch, and where each strap extends between the two exterior support patches and each end of each strap is permanently affixed to an exterior support patch, the corresponding interior support patch, and the body of the pouch for best results. In such highly preferred embodiments, the workout pouch is best configured to withstand the forces imparted during use in exercise and prevent wear-and-tear damage.

In some preferred embodiments, the ball fastener may be covered by a ball fastener protector. The ball fastener protector may comprise a two piece cover, wherein the two pieces may be in an open position or a closed position. The cover may be capable of being opened to allow a user to access the ball fastener and to readily open and close the ball fastener when needed. The cover may also be capable of being closed when the ball fastener is not being accessed by the user, wherein closing the cover hides the ball fastener from view. This protects the user from being harmed by any sharp or protruding edges of the ball fastener during use and further secures the medicine ball in the event of ball fastener failure.

The ball fastener may be a zipper, wherein the zipper extends the length of one of the fabric pieces comprising the pouch. The zipper may extend between the two support patches across one side of the body of the pouch.

Where the ball fastener is a zipper, the ball fastener protector may preferably be a zipper cover comprising two pieces. The zipper cover may be permanently affixed to the workout pouch by stitching. The two pieces of the zipper cover may be reversibly secured by a user of the workout pouch using Velcro, fastening clips, buttons, or other fasteners, thereby allowing the user to open and close the zipper cover with ease. The zipper cover may be closed during use, to protect the user from being injured by the zipper during use or handling of the workout pouch. This may also facilitate additional user comfort during use of the workout pouch.

The zipper cover may also include zipper pockets secured to the two exterior support patches on each end of the workout pouch, where one zipper pocket is secured to each exterior support patch. The zipper pockets may be used to secure and conceal the head of the zipper when tension is applied to the workout pouch during use. This will prevent the head of the zipper from interfering with use of the workout pouch and also protect the user of the workout pouch from sustaining injury caused by the head of the zipper.

The workout pouch may further comprise a handle, wherein the handle may be secured to one or more of the fabric pieces that comprise the body of the pouch or may alternatively be secured to support patches on opposite sides of the body of the pouch. The handle may increase stability of the pouch when in use, and may also aid in conforming the body of the pouch to a medicine ball contained therein.

In some embodiments, the pouch may be designed to enclose a medicine ball weighing between 4 and 20 pounds. In some embodiments, the pouch may also act as a storage accessory for a medicine ball.

FIG. 1 shows a top view of an embodiment of the workout pouch with a medicine ball contained therein. The body of the workout pouch 101 conforms to the contours of the medicine ball contained therein. The straps 102 are removable and are secured to the body of the workout pouch by snap buttons 103.

Figure 2:
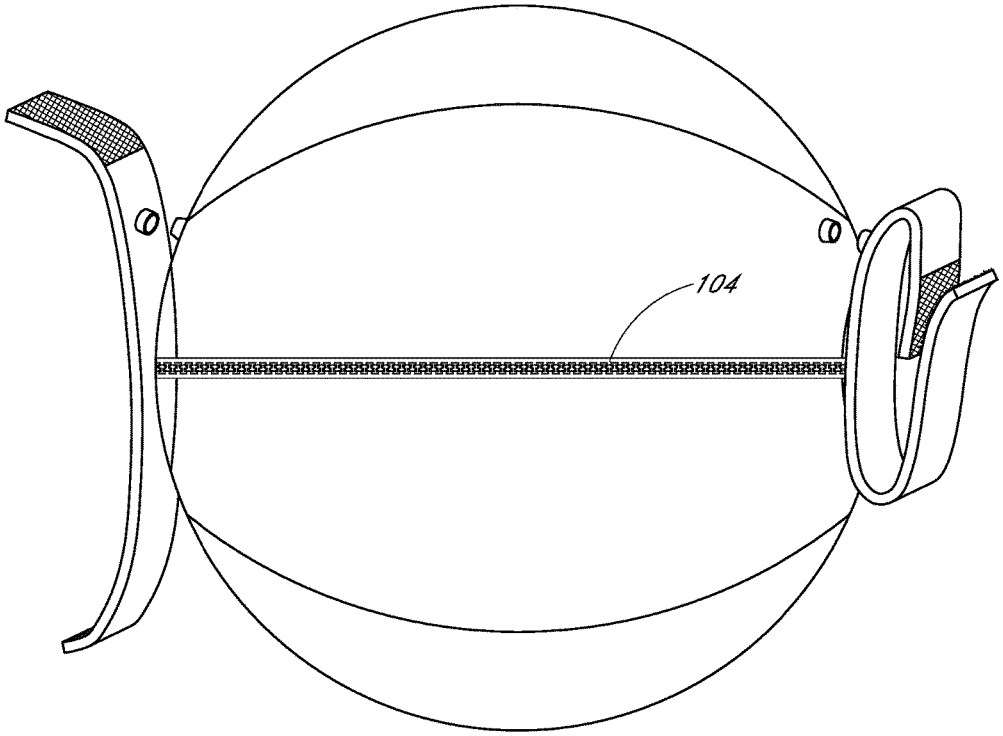
FIG. 2 shows a front view of the embodiment of the workout pouch shown in FIG. 1 with a medicine ball contained therein.

FIG. 2 shows a front view of the embodiment of the workout pouch shown in FIG. 1 with a medicine ball contained therein. The ball fastener comprises a zipper 104.

Figure 3:
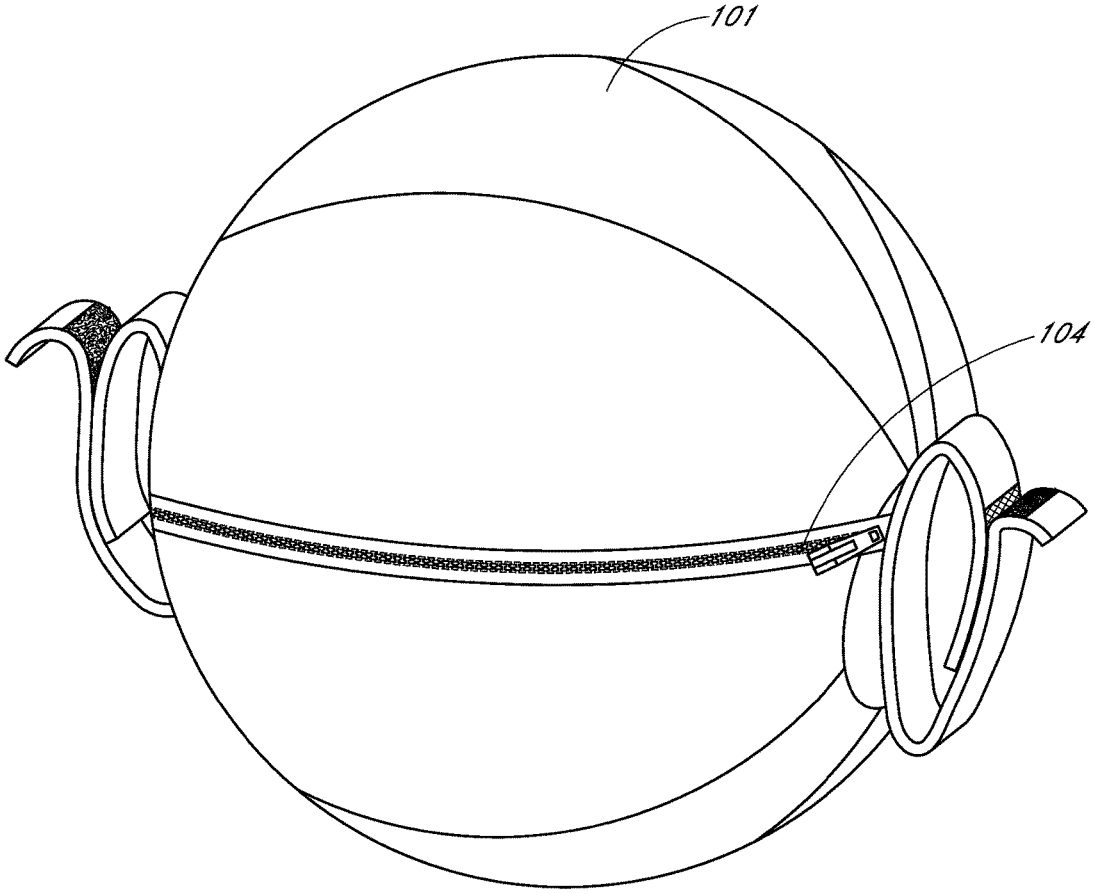
FIG. 3 shows an angled view of the embodiment of the workout pouch shown in FIG. 1 with a medicine ball contained therein.

FIG. 3 shows an angled view of the embodiment of the workout pouch shown in FIG. 1 with a medicine ball contained therein.

Figure 4:
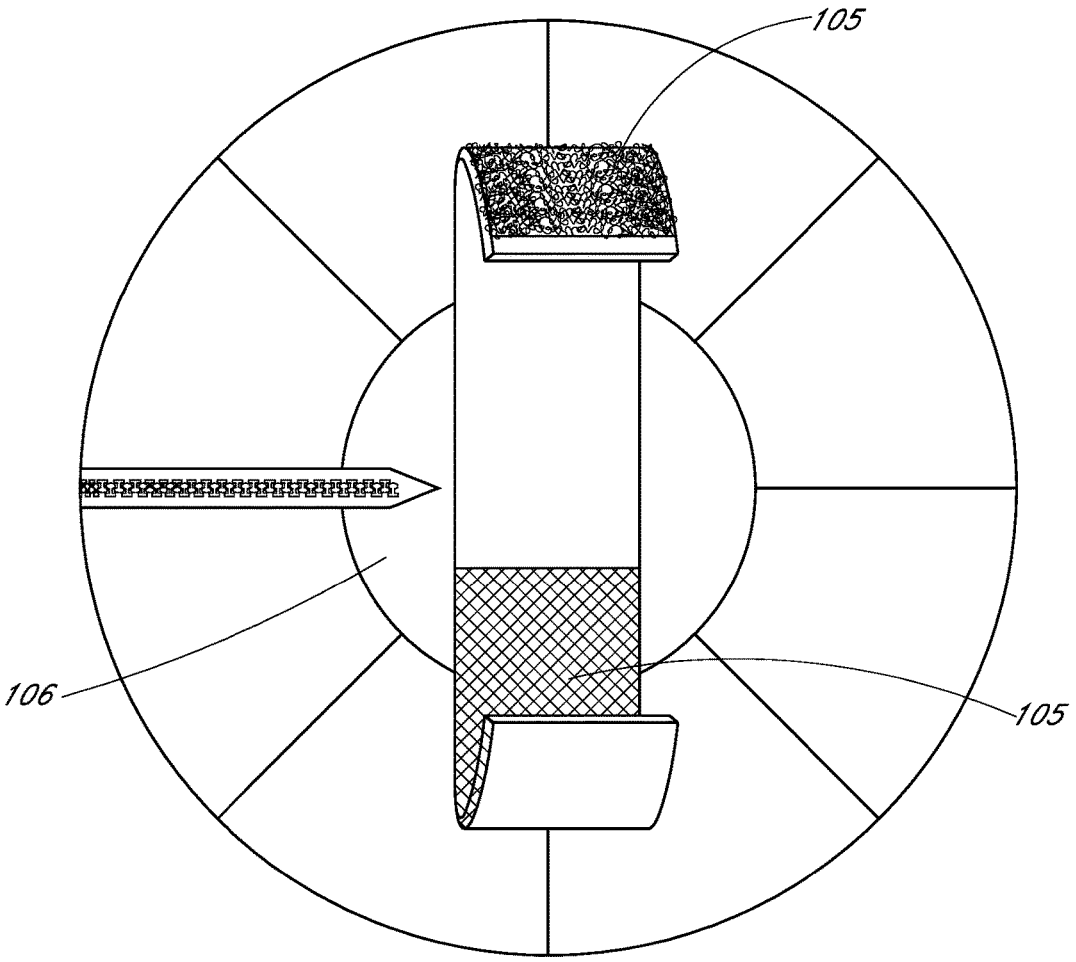
FIG. 4 shows a side view of the embodiment of the workout pouch shown in FIG. 1 with a medicine ball contained therein.

FIG. 4 shows a side view of the embodiment of the workout pouch shown in FIG. 1 with a medicine ball contained therein. Each strap may be secured by the user to the user's body using strap fastener 105. Each strap is also secured to an exterior support patch 106, and the exterior support patches are secured to opposite ends of the body of the workout pouch.

Figure 5:
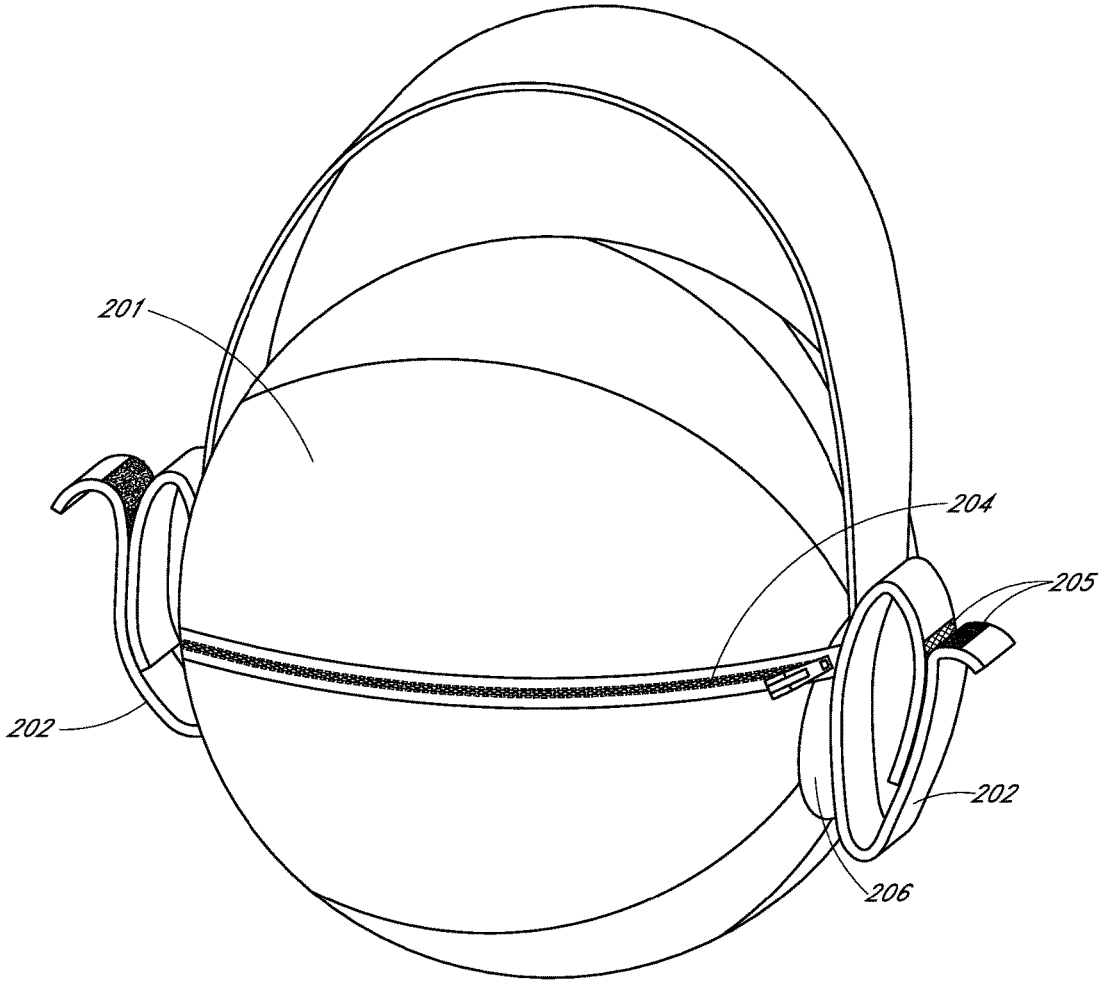
FIG. 5 shows a front view of an embodiment of the workout pouch with a handle and with a medicine ball contained therein.

FIG. 5 shows a front view of an embodiment of the workout pouch with a handle and with a medicine ball contained therein. The body of the workout pouch 201 conforms to the contours of the medicine ball contained therein. The straps 202 are removable and are secured to the body of the workout pouch by snap buttons. The ball fastener comprises a zipper 204. Each strap may be secured by the user to the user's body using strap fastener 205. Each strap is secured to an exterior support patch 206, and the exterior support patches are secured to opposite ends of the body of the workout pouch.

Figure 6:
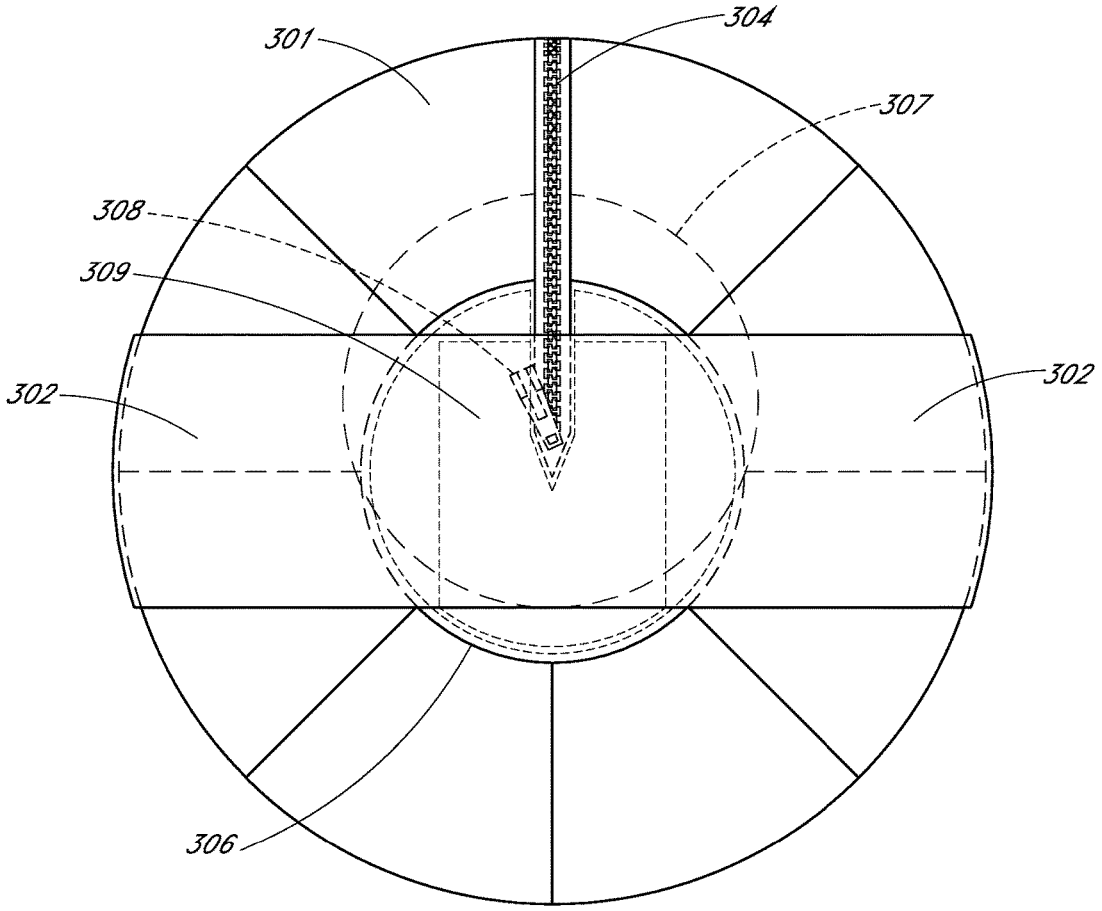
FIG. 6 shows a side view of an embodiment of the workout pouch without a handle.

FIG. 6 shows a side view of an embodiment of the workout pouch without a handle. The body of the workout pouch 301 conforms to the contours of the medicine ball contained therein. The straps 302 are permanently affixed to the body of the workout pouch. The ball fastener comprises a zipper 304. Each strap is secured to an exterior support patch 306 and an interior support patch 307, and the exterior and interior support patches on each end of the body of the workout pouch are also secured to each other and to the body of the workout pouch. The zipper head 308 is secured by zipper pockets 309 permanently affixed to each exterior support patch.

Figure 7:
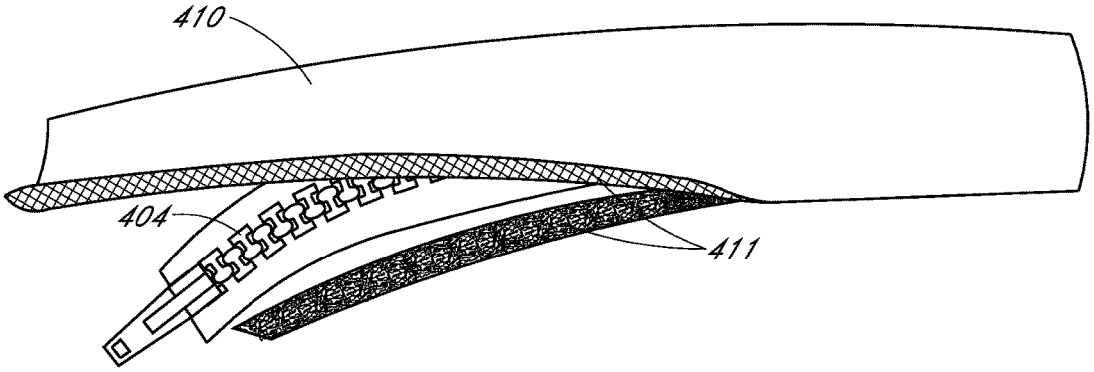
FIG. 7 shows an embodiment of a ball fastener and ball fastener protector, where the ball fastener is a zipper and the ball fastener cover is a zipper cover.

FIG. 7 shows an embodiment of a ball fastener and ball fastener protector. The ball fastener is a zipper 404 and the ball fastener protector is a zipper cover 410. The zipper cover reversibly secures the zipper using Velcro® 411.

Resistance training using a medicine ball enclosed in the disclosed workout pouch enhances the effectiveness of a given exercise and increases the variety of exercises for which a medicine ball may be used. A medicine ball is typically held in a user's hands. The disclosed workout pouch enables a user to attach the pouch containing the medicine ball to the user's legs and enables a user to perform additional exercises with the medicine ball, including exercises that will strengthen the user's core, back, quadriceps, and hamstrings. The workout pouch may also be used for plyometric exercises.

The previous description of the disclosed embodiments is provided to enable any person skilled in the art to make or use the invention disclosed herein. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

All references cited herein are expressly incorporated by reference.

What is claimed is:

1. A workout pouch comprising:

a. a body comprising multiple pieces of fabric fastened together that forms a spherical receptacle to securely contain a medicine ball when in an expanded state;

b. two straps situated on opposite sides of the body of the pouch;

c. a ball fastener configured to reversibly secure the medicine ball within the body of the pouch; and d. two exterior support patches on opposite sides of the exterior of the body of the pouch and two interior support patches on opposite sides of the interior of the body of the pouch, where each exterior support patch is situated on the same part of the body of the pouch as one interior support patch;

wherein the workout pouch conforms to the size and shape of the medicine ball and does not include substantial excess material that would allow the medicine ball to shift within the workout pouch while in use;

wherein each strap is affixed to at least one support patch and is also permanently affixed to the body of the pouch; and wherein each support patch is affixed to the body of the pouch.

2. The workout pouch of claim 1, wherein each exterior support patch is permanently affixed to each corresponding interior support patch on the same side.

3. The workout pouch of claim 2, wherein each strap extends between the two exterior support patches and each end of each strap is permanently affixed to an exterior support patch, the corresponding interior support patch, and the body of the pouch.

4. The workout pouch of claim 3, wherein the ball fastener is secured to the exterior support patches.

5. The workout pouch of claim 3, wherein the body of the pouch comprises eight pieces of fabric.

6. The workout pouch of claim 3, wherein the multiple pieces of fabric comprise one or more fabrics selected from the group consisting of leather and nylon.

7. The workout pouch of claim 3, wherein the ball fastener comprises a zipper attached to the body of the pouch.

8. The workout pouch of claim 7 further comprising a ball fastener protector.

9. The workout pouch of claim 8, wherein the ball fastener protector comprises a two piece cover capable of being opened to allow a user to access the ball fastener and readily open and close the ball fastener when needed and capable of being closed when the ball fastener is not being accessed by the user, wherein the ball fastener protector further comprises at least two zipper pockets, wherein at least one zipper pocket is located at each end of the ball fastener protector, and wherein each zipper pocket is secured to an exterior support patch.

10. The workout pouch of claim 3 further comprising a handle.

11. The workout pouch of claim 10, wherein the handle is secured to one or more of the fabric pieces that comprise the body of the pouch and is also secured to the exterior support patches.

* * * * *